US007921535B2

(12) United States Patent
Noon

(10) Patent No.: US 7,921,535 B2
(45) Date of Patent: Apr. 12, 2011

(54) METHOD OF SETTING UP A MACHINE FOR DIE CUTTING

(76) Inventor: Michael Noon, Lowell, MA (US)

( * ) Notice: Subject to any disclaimer, the term of this patent is extended or adjusted under 35 U.S.C. 154(b) by 643 days.

(21) Appl. No.: 11/975,340

(22) Filed: Oct. 19, 2007

(65) Prior Publication Data

US 2009/0100970 A1 Apr. 23, 2009

(51) Int. Cl.
*B21D 39/00* (2006.01)

(52) U.S. Cl. ..... 29/428; 29/458

(58) Field of Classification Search ..... 83/13; 76/107.1–107.8; 29/428, 458, 424
See application file for complete search history.

(56) References Cited

U.S. PATENT DOCUMENTS 6,221,291 B1 * 4/2001 Van Ert et al. ..... 264/113
6,772,661 B1 * 8/2004 Mikkelsen et al. ..... 83/13
6,976,414 B2 * 12/2005 Li et al. ..... 83/13

* cited by examiner

*Primary Examiner* — Jason Daniel Prone
(74) *Attorney, Agent, or Firm* — Joseph E. Funk

(57) ABSTRACT

A method for improving die-cutting involving first creating a back plate footprint, possessing impressions of the imperfections found in the cutting surface of a die-cutting machine. This method provides die-cutters a simple, inexpensive way to dramatically improve the alignment of die-cutting knives for making cuts. The method uses a malleable material that will readily receive an impression of imperfections of a cutting surface when some pressure is provided, but the material must also be capable of hardening into a useable solid material. The principles of this method may be applied to all die-cutting machines by making a back plate footprint of the die-cutter in question and by properly inserting it back into the chase where the impressions contained therein will press down on the material below it so as to better align the cutting knives of the die being used.

15 Claims, 1 Drawing Sheet

METHOD OF SETTING UP A MACHINE FOR DIE CUTTING

FIELD OF THE INVENTION

The present invention relates generally to methods of die-cutting and particularly to the development of using back plate footprints that improve die-cutting precision and speed, while decreasing waste material, machine down time and equipment cost because.

REFERENCES

In general within the art, descriptions of die-cutting methods and their various related elements can be found in U.S. Pat. Nos. 6,976,414 set forth by Li et al; and 6,772,661 by Mikkelsen et al. and International application PCT/SE/2006/000485 by Calvin; and U.S. Pat. No. 6,221,291 by Van Ert et al.

BACKGROUND OF INVENTION

This invention relates to die-cutting methods that involve construction of a back plate footprint where the back plate footprint is a solid material that has impressions of a cutting surface from a die-cutting machine.

As pointed out in the previous die-cutting methods fail to provide the benefits that this invention provides. None of the above-referenced US patents provide a total solution that yields the same level of improvement in efficiency and cost savings revealed in the present invention. Previous methods of improving die-cutting fall short in various ways. First, allowing for the free sliding of sheet material still does not address the problems caused by imperfections on a cutting surface, thus, cutting knives will still be damaged by the increased friction caused by these imperfections when they come in contact with the cutting surface. Using different cutting angles also does not as easily and reliably improve the cutting process to account for imperfections in the cutting surface, so knives here will also wear quickly from friction. Finally, using areas marked by graphics for making precise cuts also does not account for imperfections found on a cutting surface which lead to friction, knife wear and then loss of efficiency.

What is needed is an improved method for die-cutting that is simple and easy to use that requires a relatively short setup time and increases the speed and accuracy of die cuts while decreasing the wear on cutting knives which keeps machine downtime to a minimum and lowers maintenance costs.

SUMMARY OF THE INVENTION

The instant invention, as illustrated herein, is clearly not anticipated, rendered obvious, or even present in any of the prior art mechanisms, either alone or in any combination thereof. A method of making and using a back plate foot print that contains an impression will allow cutting knives to perfectly align with the permutations on the cutting surface. Thus the several embodiments of the instant invention are illustrated herein.

The invention encompasses a process by which a back sheet footprint is made that contains all the imperfections of the cutting surface, and inserting it into a chase, thereby aligning the cutting knives of the die with the imperfections of the cutting surface.

The process features the creation of a back sheet footprint that includes first placing a layer of a depth providing material, such as paper or other material of necessary thickness, over the cutting die. Next, a layer of a solid material is placed over the depth providing layer that is thin enough to prevent damaging the machine when it is depressed by causing too much contact, but thick enough to supply sufficient force on the malleable material (described below) to leave impressions of imperfections in the cutting surface on the malleable material. This last step is followed by placing a layer of non-stick material over the solid layer to allow for easy extraction of the malleable material.

Next, place over the cutting surface a malleable material capable of holding an impression of the imperfections of the cutting surface over the cutting surface. The amount of malleable material must be thick enough to hold an imprint of the imperfections of the cutting surface. Then, over this malleable material add a layer of a non-stick material over the malleable material for easy extraction. After the malleable material layer is added, the sides of the malleable material should be labeled so as to allow for easy identification of which side to insert when the plate is ready to be sealed in above the chase for operation of the tool.

With all the layers in place, the chase or bottom section should be depressed so as to put enough pressure to leave impressions of the cutting surfaces imperfections on the malleable material. After making the impressions in the malleable material, the material must be removed from the bottom of the cutting machine but first removing the non-stick layer over the malleable material and then removing the material itself. When removing the malleable material, care should be taken so as to not cause changes to be made in the impressions of the cutting surface. Next, additional malleable material may be added to compensate for any difference in the dimensions of the malleable material layer and the dimensions of the chase so that the malleable material will fit when later sealed inside the chase. Later, the malleable material must be cured by a hardening process that will retain the imperfections of the cutting surface imprinted on the material after hardening. After curing, the back plate footprint is ready for use.

After the back plate footprint is ready, it may be placed into the chase on top of a patch sheet. Next, the footprint is sealed inside the chase. Sealing the footprint inside the chase causes pressure on the layers below so as to match the imperfections of the cutting surface. In this way the die-cutting knives realign to more closely match the cutting surface below them, resulting in near perfect cuts each time the chase is depressed.

In one embodiment the separator layer for providing depth may be comprised of paper. Further in this embodiment, the solid material layer, which is placed over the separator layer, is comprised of plexiglass. Also in this embodiment, both of the non-stick material layers, which are placed over the solid material layer and over the die, are comprised of vinyl. In addition, in this embodiment the malleable material placed under the non-stick layer may be comprised of a polymer clay or an other similar material. Finally, in this embodiment the polymer clay should be heated and cooled at room temperature to cool for proper hardening.

DETAILED DESCRIPTION OF THE DISCLOSED EMBODIMENTS

The detailed description set forth below in connection with the appended drawings is intended as a description of presently preferred embodiments of the invention and does not represent the only forms in which the present invention may be constructed and/or utilized. The description sets forth the functions and the sequence of steps for constructing the apparatus used in the invention and method of operating the invention in connection with the illustrated embodiments. However, it is to be understood that the same or equivalent functions and sequences may be accomplished by different embodiments that are also intended to be encompassed within the spirit and scope of the invention, such as apparatuses used in the method comprised of different materials and additional steps that may aid in facilitating the use of the method.

Previous methods used to improve die-cutting all ignore the inevitable problems that are associated with imperfections found on the cutting surface. These imperfections in the cutting surface cause more friction on the cutting knives, leading to more wear, which in turn leads to higher maintenance costs, excess machine down time, and slower cutting speeds.

The present invention provides a direct solution to the friction caused by the imperfections found in the cutting surface. By introducing a back plate footprint that mirrors the imperfections found on the cutting surface, the pressure from the footprint's permutations against the other layers in the chase and down into the die layer will force the cutting knives to align more perfectly with the imperfections on the cutting surface opposing them, leading to near perfect cuts each time. Further, the costs in time, labor and materials involved in making the back plate footprint are minimal. Also, of benefit is the fact that the implementation of this method is requires little additional equipment, materials and training. Thus, avoiding the need for expensive high tech scanning equipment, visits of highly paid specialists, or to train workers.

Figure 1:
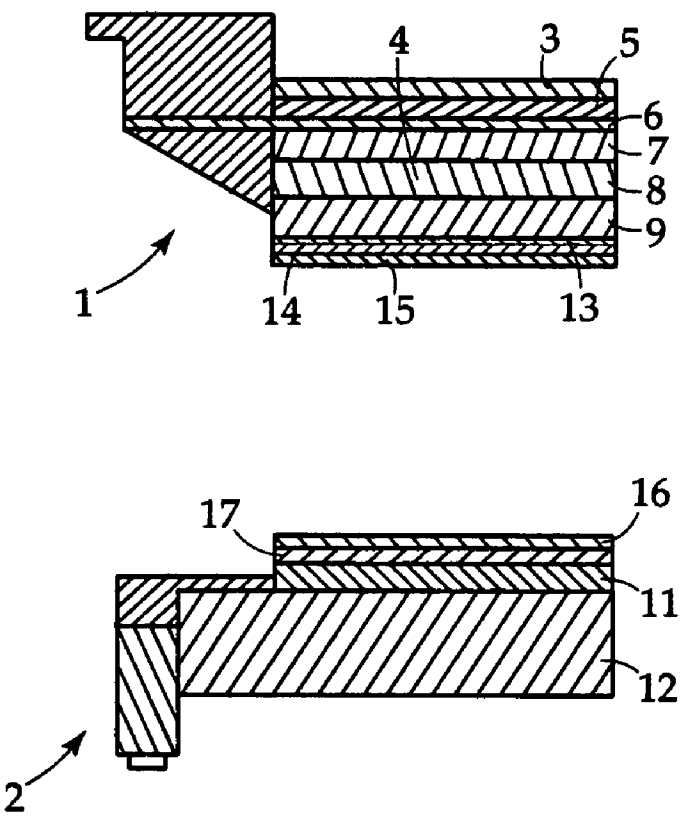
FIG. 1 illustrates a cross-section view of the top and a bottom section of a die-cutting machine with added material layers necessary during the imprint creation phase of the method to make a back plate footprint apparatus.

To further illustrate the features of the instant invention, referring to the figures, FIG. 1 shows a cross section view of the top section 1 and bottom section 2 of a die-cutting machine when ready to make a back plate footprint 18 (for purposes of this application the top section shall further be referred to as the chase). The chase 1 is comprised of a patch sheet protection plate 3, a die 4, a patch sheet 5, and a chase back plate 6. In addition, the die itself 4, is comprised of a first die wood layer 7, a second die wood layer 8 and a third rubber layer 9. The bottom section 2, of the die-cutting machine is comprised of a machine bed 12 and a cutting surface 11 lying on top of the machine bed 12.

In the process of creating the back plate footprint, a depth providing layer 13, a solid material layer 15 and a non-stick material layer 14 are added in that order, from the top down to the chase 1. The depth layer 13 is added so that the solid material layer 15 and the top non-stick layer 14 make enough contact with the bottom 2 of the die-cutting machine. This depth providing layer 13 is necessary because the chase 1 or bottom section 2 would not normally depress far enough to make full contact with the bottom 2 of the die-cutting machine since the chase 1 normally extends to a point that enables a cutting knife 10 (of FIG. 2) to cut just deep enough to make a cut in a sheet to be die cut. Thus without the depth providing layer 13 sufficient contact and pressure from the chase 1 could not be achieved to make an impression of the imperfections in the cutting surface 11. In assisting this process, the solid material layer 15 is necessary to provide a hard surface against which the malleable material layer 17 will be pressed. Also, useful in this process is a non-stick layer 14 placed over the solid material layer 15 to allow for easy extraction of the malleable material layer 17.

Once the chase 1 as shown in FIG. 1, is depressed so as to leave impressions of the cutting surface 11 on the malleable material layer 17, the non-stick material 16 and the malleable material layers 17 are removed from the bottom piece 2 of the cutting machine. Next, more malleable material is added to compensate for differences in the dimensions of the chase so that side of the malleable material layer 17 without impressions of the cutting surface is in one level plane. Then the malleable material layer 17 is hardened by a curing process. After the malleable material layer 17 has hardened, it is now a ready back plate footprint 18, and can be inserted into the chase 20, of FIG. 2.

Figure 2:
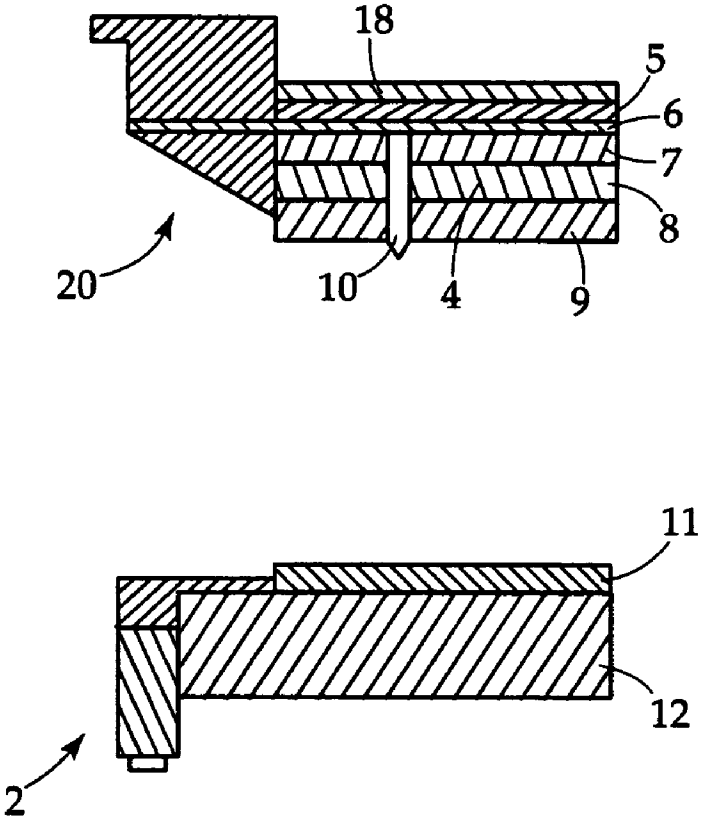
FIG. 2 illustrates a cross-section view of the top and a bottom section of a die-cutting machine when the machine is ready for cutting with a back plate footprint added where previously a patch sheet protection plate was placed.

FIG. 2 shows a cross section view of the die-cutting apparatus, comprised of a bottom piece 2 of a die-cutting machine, and a top chase 20, that now has the back plate footprint 18 inserted where the patch sheet protection plate 3 was in FIG. 1. Once the back plate footprint 18 is inserted onto the top of the chase 20, with the side containing the permutations captured by the cutting surface 11, the pressure caused by the permutations will be transferred to each successive layer below it, slightly warping them to the permutations shapes. This warping causes the die-cutting knife 10, to move in a manner to more align to match the imperfections of the cutting surface 11. Thus resulting in near perfect cuts each time the chase 20 is depressed.

In another embodiment of the invention, FIG. 1 illustrates a chase 1, where the depth providing layer 13 is comprised of a paper sheet of appropriate dimensions to cover the die 4. Also, in this embodiment the solid material layer 15 is comprised of plexiglass and the non-stick layer 14 which is comprised of vinyl. Further illustrated in FIG. 1 is the bottom piece 2 of the die-cutting machine where the non-sticky layer 16 is comprised of vinyl, and the malleable material layer 17 is comprised of a polymer clay. In this embodiment, once the polymer clay of the malleable material layer 17 is extracted, it is hardened by heating it to a temperature of 132.2 degrees Celsius (270 Fahrenheit) for 10 to 12 minutes and then cooled at room temperature for 24 hours. At this point the polymer clay is now a ready back plate footprint 18, as illustrated in FIG. 2.

In other embodiments the chase 1 (in FIG. 1), during the back plate impression creation phase may be comprised of a die 4, and as few as none of the layers illustrated above the die in FIG. 1 or as many as all such layers and additional layers as maybe be added by a die-cutting machine manufacturer or person using this invention. Further, the number of depth providing layers used to assist the chase to make contact with the cutting surface may range from zero layers to 200 layers. In these other embodiments, the chase 20 (in FIG. 2), will have a die 4, a back plate footprint 18, and as few as none of the other layers illustrated above the die 4, in FIG. 2, and as many as all such layers. Also, in other embodiments the bottom section 2 of the die-cutting machine will have a cutting surface 11 and may or may not have a bed 12.

What is claimed is:

1. A method of setting up a machine for die cutting to reduce the wear of cutting knives of the die-cutting machine, the die cutting machine having a top chase section having a bottom surface, and a bottom machine bed section having a top cutting surface, the method comprising the steps of:

a. Attaching a number of layers of different materials to the bottom surface of the top chase section in the following order;
   i. a plurality of depth providing layers ranging from 0 to 200 layers, wherein the number of layers used is determined by the number of layers necessary for the top chase section to make adequate contact with the top cutting surface of the bottom machine bed section of the die-cutting machine when the top chase section is depressed,
   ii. a solid material layer, and
   iii. a first non-stick material layer over the solid material layer;
b. Attaching both a malleable material layer capable of receiving a set of impressions of top cutting surface imperfections and a second non-stick material layer over the malleable material layer to the top cutting surface of the bottom machine bed section;
c. Depressing the top chase section onto the bottom machine bed section with sufficient force as to leave the set of impressions of the top cutting surface imperfections in the malleable material layer;
d. Raising the top chase section;
e. Removing the malleable material layer from the bottom machine bed section so as to not disturb the impressions of the top cutting surface imperfections in the malleable material layer;
f. Adding additional malleable material to the top cutting surface of the bottom machine bed section as needed to make a side of the malleable material not carrying the impressions one level plane;
g. Hardening the malleable material layer by a hardening process, thereby finishing a backplate footprint;
h. Placing and sealing the backplate footprint into the top chase section positioned over the top cutting surface so that the impressions of the top cutting surface imperfections face downward into the lower layers of the top chase section, thereby forcing the lower layers to be warped to a shape of the impressions thereby causing the cutting knives in the die to change their position to more closely align the cutting knives to match the imperfections of the top cutting surface.

2. The method of setting up a machine for die cutting of claim 1 wherein the plurality of depth providing layers are comprised of paper.

3. The method of setting up a machine for die cutting of claim 2 wherein said solid material layer is comprised of plexiglass.

4. The method of setting up a machine for die cutting of claim 3 wherein the malleable material layer is comprised of a polymer clay.

5. The method of setting up a machine for die cutting of claim 4 wherein the first non-stick material layer over the solid material layer and the second non-stick layer over the malleable material layer are comprised of vinyl.

6. The method of setting up a machine for die cutting of claim 5 wherein the step of hardening the malleable material layer by a hardening process comprises heating the polymer clay to a hardening temperature for a heating period.

7. The method of setting up a machine for die cutting of claim 6 wherein the step of hardening the malleable material layer by a hardening process further comprises cooling the polymer clay after the polymer clay has been heated.

8. The method of setting up a machine for die cutting of claim 7 wherein the hardening temperature is 132.2 degrees Celsius.

9. The method of setting up a machine for die cutting of claim 8 wherein the heating period is 10 to 12 minutes.

10. The method of setting up a machine for die cutting of claim 6 wherein the step of hardening the malleable material layer by a hardening process further comprises allowing the polymer clay that has been heated to a hardening temperature to cool over a cooling period.

11. The method of setting up a machine for die cutting of claim 10 wherein the hardening temperature is 132.2 degrees Celsius.

12. The method of setting up a machine for die cutting of claim 11 wherein the heating period is 10 to 12 minutes.

13. The method of setting up a machine for die cutting of claim 10 wherein the cooling period is 24 hours.

14. The method of setting up a machine for die cutting of claim 11 wherein the cooling period is 24 hours.

15. The method of setting up a machine for die cutting of claim 12 wherein the cooling period is 24 hours.

* * * * *